US008887947B2

(12) United States Patent
Quasters

(10) Patent No.: US 8,887,947 B2
(45) Date of Patent: Nov. 18, 2014

(54) CLOSURE FOR BEVERAGE CONTAINER AND METHOD FOR CLOSING AN OPENING OF A CONTAINER

(75) Inventor: Mikael Quasters, Vinninga (SE)

(73) Assignee: Petainer Lidkoping AB, Lidkoping (SE)

( * ) Notice: Subject to any disclaimer, the term of this patent is extended or adjusted under 35 U.S.C. 154(b) by 815 days.

(21) Appl. No.: 12/451,840

(22) PCT Filed: Jun. 5, 2008

(86) PCT No.: PCT/SE2008/050670
§ 371 (c)(1),
(2), (4) Date: Mar. 26, 2010

(87) PCT Pub. No.: WO2008/150235
PCT Pub. Date: Dec. 11, 2008

(65) Prior Publication Data

US 2010/0181330 A1 Jul. 22, 2010

(30) Foreign Application Priority Data

Jun. 5, 2007 (SE) ..... 0701388

(51) Int. Cl.

| | |
|---|---|
| ***A47G 19/22*** | (2006.01) |
| ***B67C 3/22*** | (2006.01) |
| ***B67D 1/08*** | (2006.01) |
| *B67D 1/04* | (2006.01) |

(52) U.S. Cl.
CPC ..... *B67C 3/223* (2013.01); *B67D 2001/0487* (2013.01); *B67D 2001/0481* (2013.01); *B67D 1/0832* (2013.01); *B67D 1/04* (2013.01); *B67D 1/0406* (2013.01); *B67D 1/0808* (2013.01)
USPC ..... 220/707; 215/388; 215/229; 220/203.04

(58) Field of Classification Search
USPC ..... 220/795, 705, 706, 709, 203.02, 707, 220/708, 203.04, 203.05; 215/388, 229
See application file for complete search history.

(56) References Cited

U.S. PATENT DOCUMENTS 2,400,955 A * 5/1946 Samel ..... 141/302
3,198,405 A 8/1965 Pfeil (Continued)

FOREIGN PATENT DOCUMENTS

EP 1 176 206 4/1986
EP 1 052 216 11/2000

(Continued)

OTHER PUBLICATIONS

International Search Report for PCT/SE2008/050670 mailed Sep. 18, 2008.

*Primary Examiner* — Fenn Mathew
*Assistant Examiner* — Christopher McKinley
(74) *Attorney, Agent, or Firm* — Nixon & Vanderhye, P.C.

(57) ABSTRACT

A closure (2) for a flexible container (2) comprises a valve (7, 8) which is switchable between a closed position and an open position, and a tube structure (9) arranged to be immersed in a liquid in the container (1). The valve comprises a first part (7) arranged to be inserted in an opening (10) of the container (1) and a second part (8) arranged within the first part (7), said first and second parts (7, 8) being rotatable in relation to each other for switching between the closed position and the open position of the valve. The closure (2) is made essentially of plastic material. A method of closing a flexible container (1) is also described.

20 Claims, 3 Drawing Sheets

(56) References Cited

U.S. PATENT DOCUMENTS

| | | | | | |
|---|---|---|---|---|---|
| 3,409,175 | A | * | 11/1968 | Byrne | 222/640 |
| 4,392,578 | A | * | 7/1983 | Fipp et al. | 215/231 |
| 4,984,717 | A | * | 1/1991 | Burton | 222/183 |
| 5,273,172 | A | * | 12/1993 | Rossbach et al. | 215/229 |
| 5,361,934 | A | * | 11/1994 | Spence, Jr. | 220/707 |
| 5,499,758 | A | * | 3/1996 | McCann et al. | 222/386.5 |
| 5,518,142 | A | * | 5/1996 | Lin | 220/707 |
| 5,579,948 | A | * | 12/1996 | Lin | 220/707 |
| 5,667,110 | A | * | 9/1997 | McCann et al. | 222/386.5 |
| 6,089,415 | A | | 7/2000 | Terpstra et al. | |
| 6,155,462 | A | | 12/2000 | Brecheisen et al. | |
| 6,279,787 | B1 | * | 8/2001 | Kim | 222/401 |
| 6,651,852 | B2 | * | 11/2003 | Arellano | 222/399 |
| 6,666,358 | B1 | | 12/2003 | Field | |
| 7,232,046 | B1 | * | 6/2007 | Stassi | 222/400.8 |
| 7,367,479 | B2 | * | 5/2008 | Sitz | 222/400.7 |
| 2002/0017525 | A1 | * | 2/2002 | Searle et al. | 220/366.1 |
| 2010/0101426 | A1 | * | 4/2010 | De Mei | 99/277.1 |

FOREIGN PATENT DOCUMENTS

| | | | |
|---|---|---|---|
| FR | 2 787 436 | | 6/2000 |
| GB | 768239 | | 2/1957 |
| GB | 2 277 576 | A | 11/1994 |
| JP | 2000-355347 | | 12/2000 |
| WO | 99/11563 | | 3/1999 |
| WO | 02/070394 | | 9/2002 |
| WO | 03/093163 | | 11/2003 |
| WO | 2004/099060 | A2 | 11/2004 |
| WO | 2006/110948 | | 10/2006 |

* cited by examiner

CLOSURE FOR BEVERAGE CONTAINER AND METHOD FOR CLOSING AN OPENING OF A CONTAINER

This application is the U.S. national phase of International Application No. PCT/SE2008/050670 filed 5 Jun. 2008, which designated the U.S., and claims priority to Swedish application No. 0701388-1, filed 5 Jun. 2007 the entire contents of each of which are hereby incorporated by reference.

FIELD OF THE INVENTION

The present invention relates to a closure for a flexible container, comprising a valve which is switchable between a closed position and an open position, and a tube structure arranged to be immersed in a liquid in the container.

The present invention also relates to a method for closing an opening of a flexible container containing a carbonated liquid with a closure comprising a valve which is switchable between a closed position and an open position and a tube structure arranged to be immersed in the liquid.

TECHNICAL BACKGROUND

Beverages, particularly draught beer, are usually delivered to outlets like restaurants and bars in large metallic kegs. The kegs are closed by means of a closure that can be connected in a bar by means of a metallic dispense head. The dispense head connects the beer keg to a delivery line for delivery of the beer from the keg to the bar tap and to a gas line that feeds propellant gas into the keg for driving the beer out of the keg. Different breweries use different types of closures and therefore the bar has to have the right type of dispense head that fits the specific closure of the beer keg in question. In order to be able to switch between different types of kegs with associated different types of dispense heads, the bar or restaurant has to keep several dispense heads in stock. One of the many drawbacks of these metallic kegs and the associated metallic closures is that they are expensive to manufacture and therefore have to be used several times. Thus, there is a need of thorough cleaning of the keg and the dispense head and the connected delivery line and gas line. In the case of the keg, cleaning is done at the brewery, but the dispense head and the delivery and gas lines have to be cleaned in the restaurant or bar. This is a time consuming task which is most likely sometimes overlooked in restaurants and bars.

Recently plastic containers for draught beer have been developed, as well as plastic closures. These plastic closures are, however, very complex. There are examples with as many as 17 different parts. This makes manufacture complicated and expensive. With these closures it is necessary to fill the container through the closure and first the container and closure are rinsed with carbon dioxide through the closure in order to remove oxygen from the inside of the container and the closure. Oxygen might otherwise spoil the beverage.

SUMMARY OF THE INVENTION

An object of the present invention is to provide a closure for a flexible container, which has fewer components than prior art closures.

Another object of the invention is to provide a closure which is intended for single use, thus avoiding hygienic problems.

Yet another object of the invention is to provide a closure that allows capping after the container has been filled, thereby allowing quick and flexible filling.

In the closure of the invention the valve comprises a first part arranged to be inserted in an opening of the container and a second part arranged within the first part, said first and second parts being rotatable in relation to each other for switching between the closed position and the open position of the valve. The closure is made essentially of plastic material. This closure needs only few parts, namely the two valve parts and the tube structure for connecting the container to the bar piping system. The plastic material makes the closure inexpensive to manufacture and the closure may therefore be discarded after a single use.

The liquid in the container is preferably a beverage, in particular beer.

According to a preferred embodiment of the invention, in the closed position of the valve the tube structure communicates with a headspace in the container and in the open position of the valve the tube structure communicates with a delivery line for delivery of the liquid. A gas port in the closure communicates with a gas source for supply of propellant gas into the container. Thus the closure provides one valve position for transportation of the liquid in the container and one valve position for dispensing the liquid.

The second valve part is preferably arranged to be rotated approximately 90° between the closed position and the open position of the valve. This makes the closure straightforward to manufacture and to operate.

The second valve part may comprise a handle for rotating the second valve part between the closed position and the open position of the valve, thus simplifying operation of the valve.

The closure may further comprise snap lock means for engaging a portion of the container at the opening of the container. Thereby, the closure can be securely held in the opening of the container even though the pressure inside the container rises.

The closure is preferably formed by injection moulding, which is a very effective method of forming plastic parts.

The closure may advantageously be formed by two-component injection moulding, whereby sealing portions for sealing the closure against the opening of the container and for sealing between the first and second valve parts are injection moulded in the same mould as the first and second valve parts, respectively. This is a particularly effective way of forming a closure with sealing rings.

The sealing portions are preferably made of elastomeric material, which can easily be formed in the desired shape and which has good sealing properties.

The sealing portions may comprise an oxygen scavenger. Thereby, oxygen sensitive liquids may be protected inside the container.

The plastic material of the closure is preferably polypropylene. This is today a cost effective material. Polyethylene may also be used, as well as other polyolefines. The plastic material will usually be a thermoplastic.

The inventive method for closing an opening of a flexible container containing a liquid is characterised by the steps of:

applying an outside pressure on the open container such that the container is deformed, thereby reducing a headspace in the container, inserting the closure with the tube structure in the opening of the container, with the valve in the closed position, releasing the outside pressure on the container, such that a gas in the container fills the headspace. With this method it is possible to fill the container before the container is closed with the closure, since the headspace increases when the pressure on the container is released, whereby a gas in the container fills the headspace.

In the case of a carbonated liquid, the gas that fills the headspace is carbon dioxide leaving the liquid when the outside pressure on the container is released.

In the case of a non-carbonated liquid, a small amount of a compound that at normal temperature and pressure evaporates to form gas, e.g. nitrogen, is added to the container and when the outside pressure on the is released, the gaseous compound fills the headspace.

BRIEF DESCRIPTION OF THE DRAWINGS

The invention will now be described in closer detail, by way of example only, with reference to the appended schematic drawings, which show a currently preferred embodiment of the invention.

DETAILED DESCRIPTION OF PREFERRED EMBODIMENTS

Figure 1:
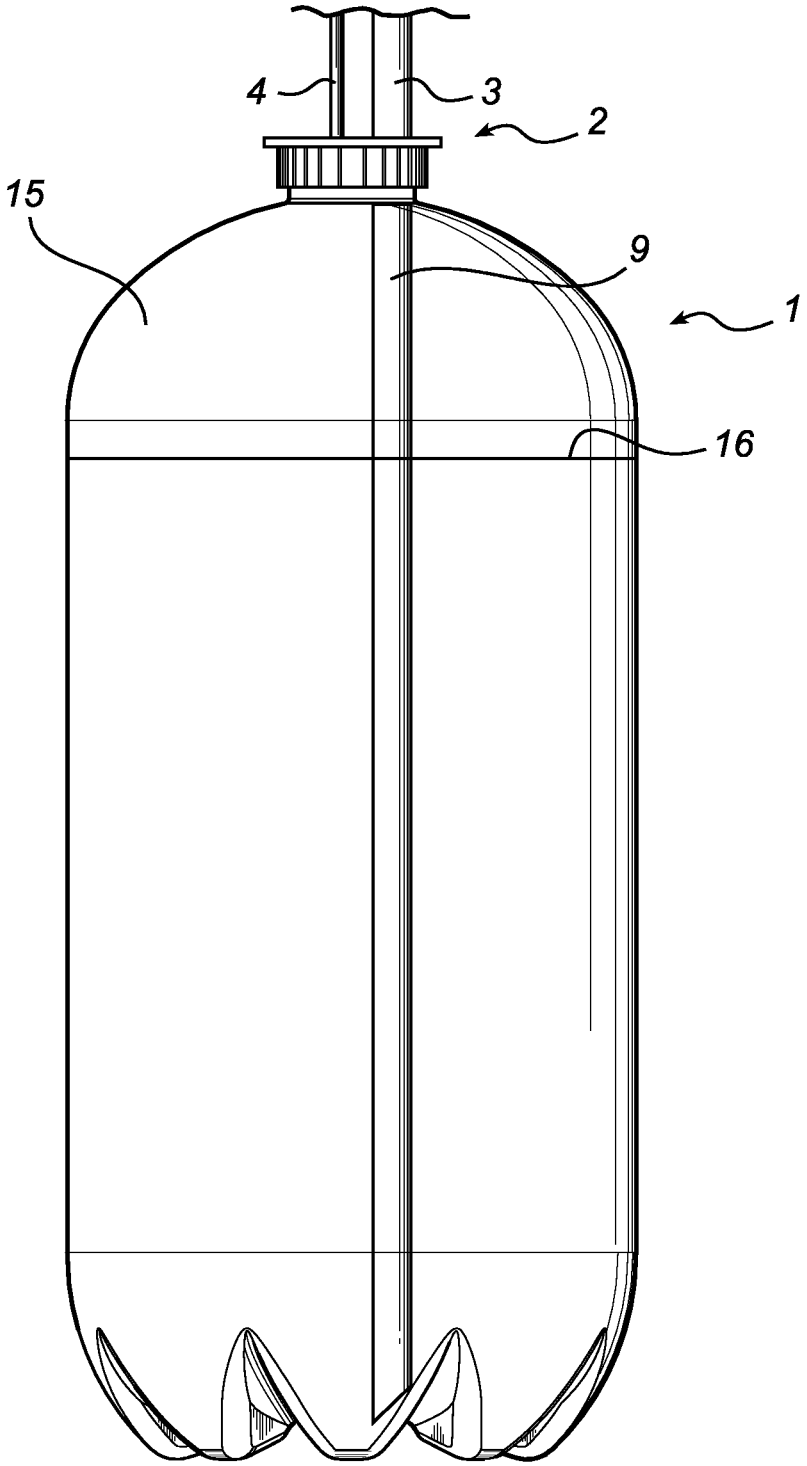
FIG. 1 is a side view of a container with a closure according to the invention connected to a delivery line and a propellant gas line.
Figure 2:
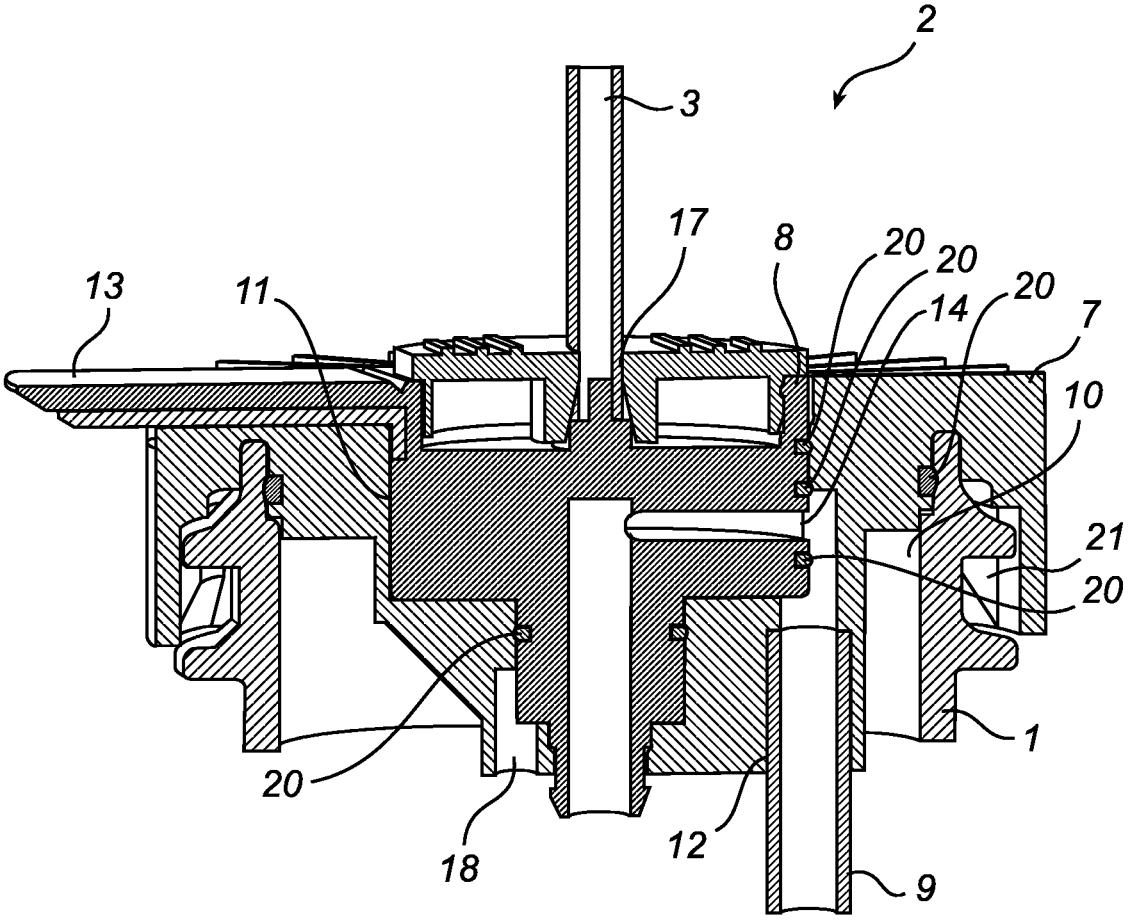
FIG. 2 is a sectional view of a closure according to the invention in a closed position.
Figure 3:
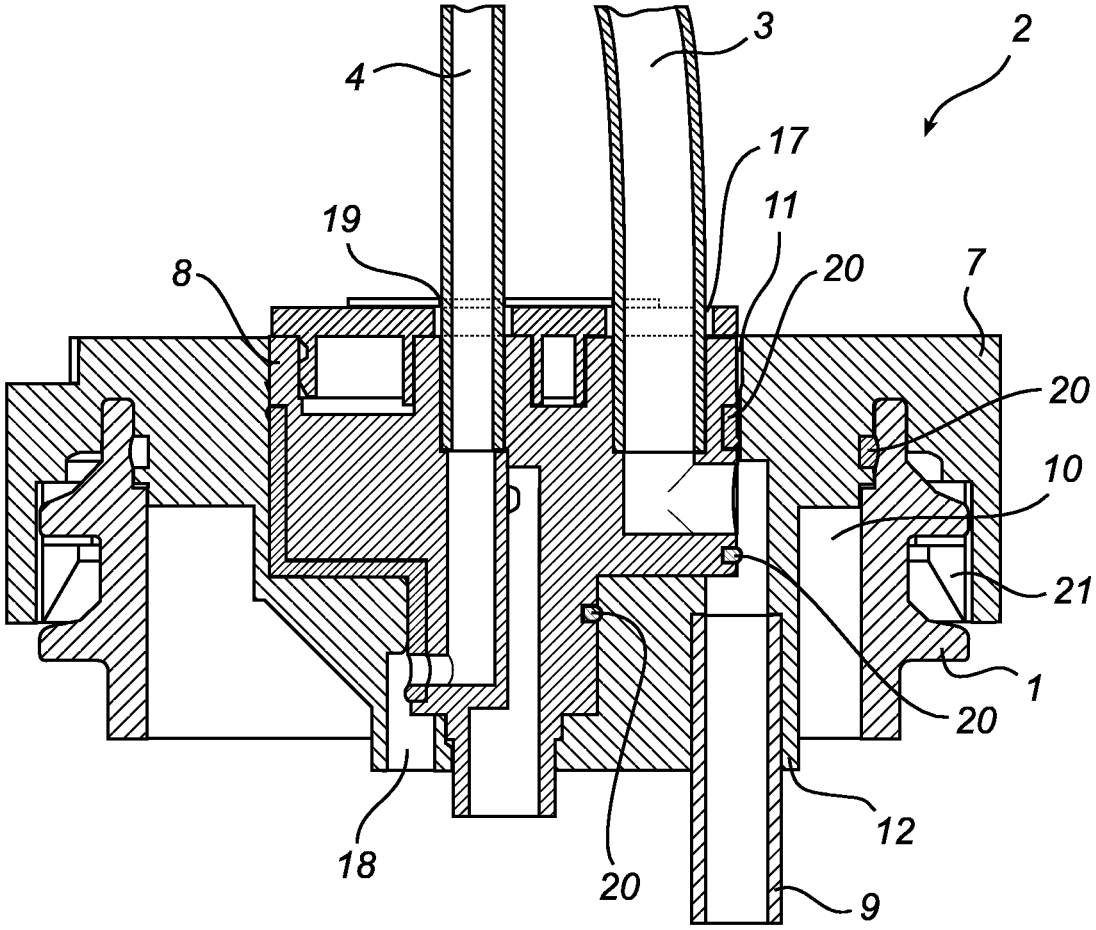
FIG. 3 is a sectional view of the closure of FIG. 2 in an open position.

The container 1 shown in FIG. 1 is closed by means of a closure 2 and connected via a delivery line 3 and a gas line 4 to the draught beer equipment of a bar (not shown). The container 1 is made of plastic and is flexible, although rigid enough to be able to stand.

The delivery line 3 connected to the closure 2 is connected to the delivery line of the bar via a standardised quick coupling (not shown). Similarly, the gas line 4 connected to the closure 2 is connected to the gas line of the bar via a standardised quick coupling (not shown). Thus, the need for a separate dispense head is eliminated. Thereby, the container 1 with the closure 2 can be connected to any bar, regardless of the draught beer equipment previously used. The delivery line 3 and the gas line 4 may be delivered with the closure 1 or may be supplied separately.

The closure 2 is made up of three parts: a first valve part 7, a second valve part 8 and a tube structure 9. The first valve part 7 is essentially cylindrical and fits into the opening 10 of the container 1. The second valve part 8 is also essentially cylindrical and fits inside an inner hole 11 of the first valve part 7. The tube structure 9 is connected to a liquid port 12 in the second valve part 8 and extends down into the beer in the container 1.

The second valve part 8 is rotatable in the inner hole 11 of the first valve part 7. By rotating the second valve part 8 in relation to the first valve part 7 by means of a handle 13 a closed position and an open position of the valve of the closure 1 can be obtained. The closed position and open position are 90° apart.

In the closed position, the liquid port 12 communicates with an evacuation port in the second valve part 8. Thereby, the tube structure 9 communicates with a headspace 15 above the liquid surface 16 in the container 1.

In the open position, the liquid port 12 communicates with a first connection port 17 on the outside of the first valve part. The first connection port 17 is connected via the delivery line 3 to the tap (not shown) in the bar. A gas port 18 on the inside of the second valve part 8 communicates with a second connection port 19 on the outside of the second valve part 8. The second connection port 19 is connected via the gas line 4 to a source of propellant gas in the bar. For beer, the propellant gas will normally be carbon dioxide.

The use of the container 1 with the closure 2 will now be described. The container 1 is filled with beer and an outside pressure is applied on the container before the container is closed by means of the closure. The squeezing of the container 1 reduces the headspace 15 above the beer in the container 1. The closure 2 is placed in the opening 10 of the container 1 in the closed position and the pressure on the container 1 is subsequently released. Since the valve of the closure 2 is in the closed position, the tube structure communicates, via the evacuation port, with the headspace 15. Therefore, the liquid level in the tube structure 9 will be the same as in the container 1. The release of the pressure on the container 1 causes carbon dioxide to leave the beer and fill the headspace 15. This closing method reduces the amount of oxygen in the closed container 1. In the case of foaming beverages, such as beer, foam will be created when the pressure on the container 1 is released and the foam, containing bubbles of carbon dioxide, will fill the headspace 15.

When the container 1 is connected to a bar, the second valve part 8 is rotated by means of the handle 13 to the open position. Propellant gas in the form of carbon dioxide is supplied from a gas bottle (not shown) in the bar. The propellant gas enters the container 1 through the second connection port 19 and the gas port 18 and pushes the beer out of the container, through the liquid port 16 and the first connection port 17. As the volume of beer in the container decreases, the amount of propellant gas in the increasing headspace 15 increases.

The first valve part 7 and the second valve part 8 of the closure 2 are made of polypropylene. The respective valve part 7, 8 can be moulded first, with channels for sealing rings 20. Once the valve part 7, 8 has been moulded, sealing rings 20 of an elastomeric material, e.g. polyolefin based, are arranged in the channels. The sealing rings 20 seal against the inside of the opening 10 of the container 1 and between the two valve parts 7, 8.

For optimal protection of oxygen sensitive beverages, the sealing rings 20 could contain an oxygen scavenger and the valve parts 7, 8 could be coated with, e.g., silicon oxide.

The closure 2, the delivery line 3 and the gas line 4 are intended for single use. Thus, the need for cleaning is reduced. Only the delivery line and gas line of the bar have to be cleaned. When the container 1 has been emptied, the container 1 and the closure 2 are discarded.

The closure 2 is securely held in the opening 10 of the container 1 by means of snap lock means 21 and the sealing rings 20. Thereby, the closure may resist a pressure exceeding the burst pressure of the container 1.

In the embodiment described above, the liquid in the container is beer. However, other beverages, such as water, wine, juice or milk may of course also be stored in and dispensed from the container 1 by means of the closure 2 of the invention. To get the full advantage of the closing method described, the beverage should be carbonated. Milk may for instance be carbonated with up to 1 g $CO_2$/L without the consumer being able to notice the carbonation. In the case of non-carbonated beverages, nitrogen may be used as propellant gas, instead of carbon dioxide. Other propellant gases are also possible. For instance, in the case of low-carbonated beverages, a mixture of carbon dioxide and nitrogen may be used. Other liquids, e.g. cooking oil, are also possible to store in the container 1 and dispense via the closure 2 of the invention.

If a non-carbonated beverage or other liquid is to be stored in and dispensed from the container by means of the inventive closure 2, the following method may be used:

1) a small amount of liquid nitrogen is added in the empty container,
2) the non-carbonated liquid is filled in the container,
3) the closure is immediately thereafter inserted in the opening of the container, thus sealing the container.

The liquid nitrogen quickly evaporates to form gaseous nitrogen. As long as the container is sealed shortly enough after filling, gaseous nitrogen will remain in the container, filling the headspace above the non-carbonated liquid. Thereby, oxygen sensitive liquids may be protected from exposure to oxygen.

The skilled person will realise that the embodiment described above can be modified in a number of ways without departing from the scope of the claims.

For instance, the open and closed position of the valve need not be 90° apart, but could be separated by another angle. It is, however, preferable not to have to turn the inner valve part 8 more than one revolution between the open and closed positions.

Other materials could be used. The first and second valve parts 7, 8 could, e.g., be made from polyethylene, or other polyolefines.

The closure of the invention is particularly suited for a flexible container and the closing method of the invention is only feasible with a flexible container. However, the closure could also be used with a rigid container, such as a regular metallic beer keg. In such case, filling of the container should be done through the closure, since the possibility of reducing the headspace by squeezing the container is not available for rigid containers.

Although less desirable, it is possible to deliver the container 1, with the closure 2 already in place, to a brewer, whereafter the brewer fills the container 1 through the closure 2.

Even though it is preferred to use the delivery line 3 and gas line 4 only once and discarding them after use, it is of course also possible to reuse them. However, such reuse increases the need of cleaning.

The invention claimed is:

1. A closure for a flexible container, comprising:

a valve switchable between a closed position and an open position; and a tube structure arranged to be immersed in a liquid in the container, wherein the valve comprises a first valve part arranged to be inserted in an opening of the container and a second valve part arranged within the first valve part, said first valve part and said second valve part being rotatable in relation to each other to switch between the closed position and the open position of the valve, wherein the closure is made essentially of plastic material, wherein the tube structure communicates with a headspace in the container in the closed position of the valve, wherein the tube structure communicates with a delivery line for delivery of the liquid in the open position of the valve, wherein a gas port in the closure communicates with a gas source for supply of propellant gas into the container, wherein an upper end of the tube structure is in communication with the headspace through an evacuation port of the valve when the valve is in the closed position, and wherein the upper end of the tube structure is arranged to only communicate with the headspace in the container in the closed position of the valve.

2. A closure as claimed in claim 1, wherein the second valve part is arranged to be rotated approximately 90° between the closed position and the open position of the valve.

3. A closure as claimed in claim 2, wherein the second valve part comprises a handle for rotating the second valve part between the closed position and the open position of the valve.

4. A closure as claimed in claim 1, further comprising snap lock means for engaging a portion of the container at the opening of the container.

5. A closure as claimed in claim 1, wherein the closure is formed by injection moulding.

6. A closure as claimed in claim 5, further comprising sealing portions for sealing the closure against the opening of the container and for sealing between the first valve part and the second valve part.

7. A closure as claimed in claim 6, wherein said sealing portions are made of elastomeric material.

8. A closure as claimed in claim 6, wherein the sealing portions comprise an oxygen scavenger.

9. A closure as claimed in claim 1, wherein the plastic material is a thermoplastic.

10. A closure as claimed in claim 1, wherein the plastic material is polypropylene.

11. A method for closing an opening of a flexible container containing a liquid with a closure as claimed in claim 1, comprising a valve which is switchable between a closed position and an open position and a tube structure arranged to be immersed in the liquid, the method comprising the steps of:

applying an outside pressure on the container with the valve in the open position such that the container is deformed, thereby reducing a headspace in the container, inserting the closure with the tube structure in the opening of the container, and with the valve in the closed position, releasing the outside pressure on the container, such that a gas in the container fills the headspace.

12. A method as claimed in claim 11, wherein the liquid in the container is a carbonated liquid and wherein when the outside pressure on the container is released, carbon dioxide leaves the carbonated liquid and enters the headspace.

13. A method as claimed in claim 11, wherein a small amount of a liquid compound that at normal temperature and pressure evaporates to form a gaseous compound is added in the container and wherein when the outside pressure on the container is released, the gaseous compound fills the headspace.

14. A method as claimed in claim 13, wherein the gaseous compound comprises nitrogen.

15. A closure as claimed in claim 1, wherein the tube structure is at least partly immersed in the liquid in the container.

16. A closure as claimed in claim 1, wherein the tube structure is immersed in the liquid in the container.

17. A closure as claimed in claim 1, wherein in the closed position of the valve the tube structure is arranged to communicate with the headspace in the container whilst the tube structure is at least partly immersed in the liquid in the container.

18. A closure as claimed in claim 1, wherein in the closed position of the valve the tube structure is arranged to communicate with the headspace in the container so that a liquid level in the tube structure is equal to a liquid level in the container.

19. A closure for a flexible container, comprising:

a valve switchable between a closed position and an open position; and a tube structure arranged to be immersed in a liquid in the container, wherein the valve comprises a first valve part arranged to be inserted in an opening of the container and a second valve part arranged within the first valve part, said first valve part and said second valve part being rotatable in relation to each other to switch between the closed position and the open position of the valve, wherein the closure is made essentially of plastic material, wherein the tube structure communicates with a headspace in the container in the closed position of the valve, wherein the tube structure communicates with a delivery line for delivery of the liquid in the open position of the valve, wherein a gas port in the closure communicates with a gas source for supply of propellant gas into the container, wherein the tube structure is at least partly immersed in the liquid in the container, and wherein an upper end of the tube structure is arranged to only communicate with the headspace in the container in the closed position of the valve.

20. A closure for a flexible container, comprising:

a valve switchable between a closed position and an open position; and a tube structure arranged to be immersed in a liquid in the container, wherein the valve comprises a first valve part arranged to be inserted in an opening of the container and a second valve part arranged within the first valve part, said first valve part and said second valve part being rotatable in relation to each other to switch between the closed position and the open position of the valve, wherein the closure is made essentially of plastic material, wherein the tube structure communicates with a headspace in the container in the closed position of the valve, wherein the tube structure communicates with a delivery line for delivery of the liquid in the open position of the valve, wherein a gas port in the closure communicates with a gas source for supply of propellant gas into the container, wherein the tube structure is arranged to communicate with the headspace in the container in the closed position of the valve so that a liquid level in the tube structure is equal to a liquid level in the container, and wherein an upper end of the tube structure is arranged to only communicate headspace in the container in the closed position of the valve.

* * * * *